United States Patent [19]

Guolo

[11] 4,096,648

[45] Jun. 27, 1978

[54] SKI BOOT FASTENER

[75] Inventor: Giuseppe Guolo, Treviso, Italy

[73] Assignee: Calzaturificio Giuseppe Garbuio S.A.S., Treviso, Italy

[21] Appl. No.: 730,686

[22] Filed: Oct. 7, 1976

[30] Foreign Application Priority Data

Oct. 10, 1975 Italy ..... 84149 A/75

[51] Int. Cl.[2] ..... A43B 11/00; A43C 11/00

[52] U.S. Cl. ..... 36/50; 24/68 SK

[58] Field of Search ..... 24/68 SK, 68 E, 69 SK, 24/69 ST, 70 SK, 70 ST, 71 SK; 36/50, 58.5, 117, 118, 120, 121

[56] References Cited

U.S. PATENT DOCUMENTS

| | | | |
|---|---|---|---|
| 3,224,118 | 12/1965 | Teufel | 36/50 |
| 3,333,301 | 8/1967 | Lubian | 24/70 SK |
| 3,363,288 | 1/1968 | Lange et al. | 36/50 X |
| 3,407,450 | 10/1968 | Baso | 36/50 X |
| 3,408,752 | 11/1968 | Lollmann | 24/70 SK X |
| 3,494,054 | 2/1970 | Lange | 36/120 |
| 3,683,460 | 8/1972 | Baso | 24/70 SK |

*Primary Examiner*—Doris L. Troutman
*Attorney, Agent, or Firm*—D. Paul Weaver

[57] ABSTRACT

Fastening loops are attached directly to a vamp side or to leg strap extensions for engagement with fastening levers on the opposite side of the vamp. The interior surface of the vamp or of each strap extension is recessed to form flush engaging elements, any one of which can be connected with the inward end of a fastening loop so that the latter is adjustably held on the vamp or on a strap extension. No uncomfortable projections are created on the interior surface of the vamp or strap extensions and the outer surface is smooth for improved appearance and/or to accept visible indicia.

8 Claims, 11 Drawing Figures

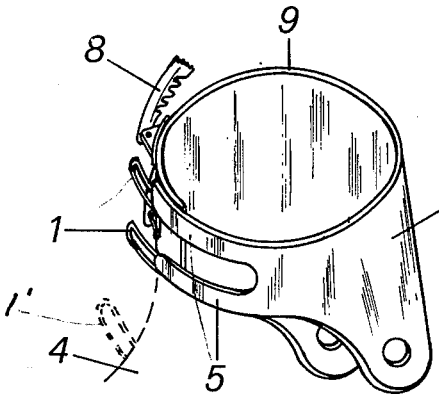
FIG.1
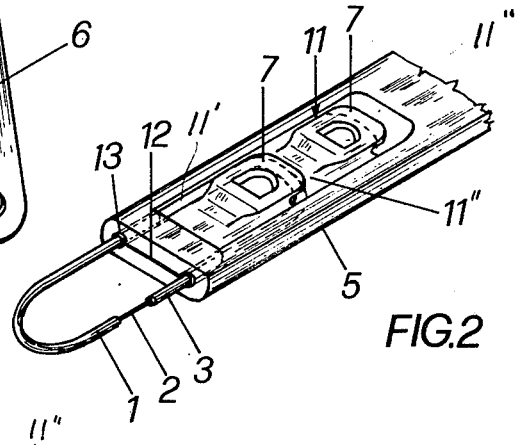
FIG.2
FIG.3
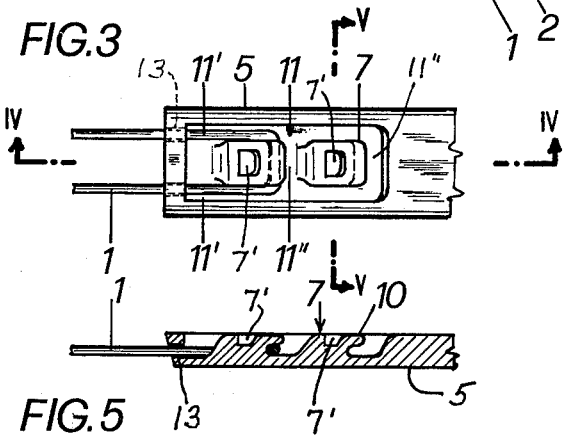
FIG.5
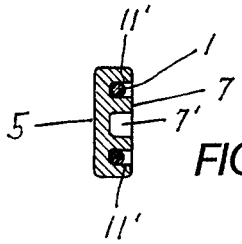
FIG.4
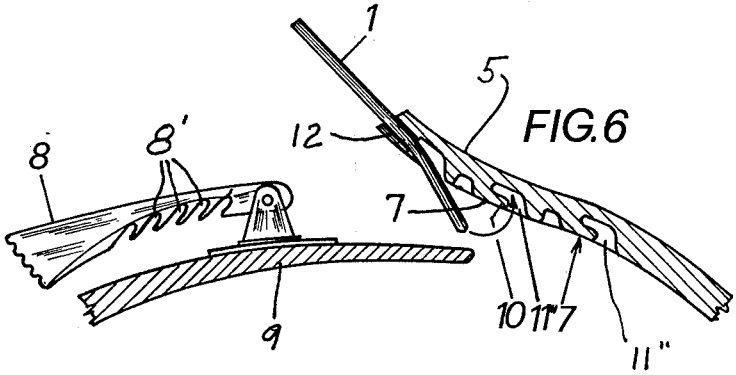
FIG.6

SKI BOOT FASTENER

BACKGROUND OF THE INVENTION

Ski boot fasteners are known in which fastening loops or rings on one side of the vamp engage with mechanical lever fasteners on the other side, said fasteners having notches to receive the fastening loop or ring selectively when closing the boot. These known fastening loops or rings are connected to the vamp by a metal plate, or more recently, by loop attaching elements which project outwardly from the vamp and are formed directly during manufacturing of the vamp. In this manner, the elimination of certain manufacturing operations (fixing the ring connecting plates to the vamp) has been possible, with reduced manufacturing cost. Also, it has been possible to replace damaged loops or rings quickly without returning the boot to the factory.

Certain disadvantages are present even in the latest arrangements due to the loop attaching elements projecting outwardly from the exterior face of the vamp. One disadvantage is that the presence of these outward formations alters the shape linearity of the boot and prevents application of writing or other indicia on the exterior of the boot, especially on the strap or straps which squeeze the leg portion. A further disadvantage of these known fasteners is that the loop or ring, particularly when constructed of steel cable, requires the presence of a band or other restraining device on the edge of the vamp for those periods in which it is not engaged by the fastening lever. This results in increased production cost and again in adversely affecting the shape of the boot. A final disadvantage is that where several fastening elements are provided to allow adjusting the fastener loop these tend to diverge because of the vamp shape, which, during boot fastening increasingly curves to conform to the foot of the skier. Because of this, the effectiveness of the fastening loop or ring is diminished.

SUMMARY OF THE INVENTION

By means of the invention, the above-stated disadvantages of the prior art are eliminated by provision of a ski boot fastener in which a fastening loop and securing elements formed directly on the vamp interior or on the interiors of strap extensions are flush with the inner surface of the vamp. Uncomfortable inner surface projections are eliminated while the exterior surface remains smooth for good appearance or to accept indicia. The loop securing projections on the interior surface are formed by grooving or recessing the vamp or strap extensions so that the projections which form loop securing elements are flush with the internal surface.

Other features and advantages of the invention will become apparent during the course of the following description.

BRIEF DESCRIPTION OF THE DRAWINGS

FIG. 1 is a partial perspective view of a ski boot leg portion having fasteners embodying the invention.

FIG. 2 is an enlarged fragmentary perspective view of a strap extension and associated fastening loop and showing the interior side of the strap extension.

FIG. 3 is an interior side elevation of the strap extension shown in FIG. 2.

FIG. 4 is a longitudinal vertical section taken on line 4—4 of FIG. 3.

FIG. 5 is a transverse vertical section taken on line 5—5 of FIG. 3.

FIG. 6 is a cross sectional view through the strap extension similar to FIG. 4 showing the application and adjustment of the fastening loop thereto.

DETAILED DESCRIPTION

Figure 7:
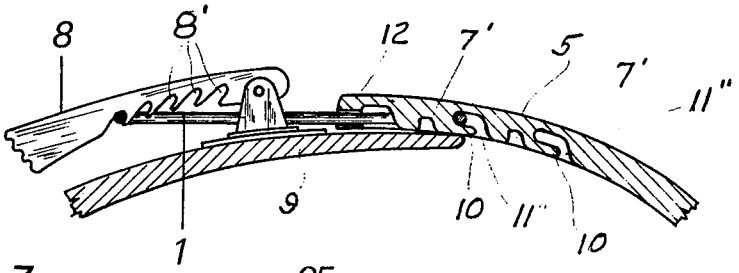
FIG. 7 is a further view similar to FIG. 6 illustrating the ski boot fastener completely closed.

Referring to the drawings in detail, and initially referring to FIGS. 1 through 7, a preferably somewhat flexible fastening loop 1 formed from a steel cable 2 with a plastic sheath 3 is provided. The loop 1 is completely closed or endless. One or more of the loops 1 may be attached directly to a continuous vamp side 4 as indicated at 1' in FIG. 1 or to a desired number of strap extensions 5 formed on a leg portion 6 of the boot. The leg portion 6 or gaiter is of the type found on conventional plastic ski boots as disclosed, for example, in U.S. Pat. No. 3,494,054, issued to R. B. Lange. The gaiter 6 is hinged or pivoted through its lower end apertures to the shell of the boot, not shown, in the manner illustrated in the Lange patent.

During the manufacture of the vamp or leg portion, as shown in FIGS. 2 through 5, a pair or more of loop securing elements 7 are formed in longitudinally spaced relation on the interior surface of each strap extension 5, or similarly, on the interior surface of the vamp where strap extensions are not used. The elements 7 have their tops flush with the interior face of strap extension 5 so that no uncomfortable internal projections are created to bear against the leg of the wearer of the boot. The elements 7 are produced by grooving or recessing the strap interior at 11, including longitudinal groove channels 11' and cross channels 11'', thus rendering the securing elements 7 separate and distinct for selective engagement with the inner end of a loop 1. Each element or projection 7 is tapered in cross section, FIG. 4, being approximately frustroconical, with a rearward overhanging lip 10 under which the closed end of the loop 1 may be engaged securely, as shown. Varying numbers of the elements 7 may be formed during manufacturing. The arrangement renders the loop 1 adjustable lengthwise on the strap extension 5. The loop 1 is inserted through an end slot 12 in the strap extension, which slot communicates with the recess or cavity in which the elements 7 are located. The two parallel branches of the loop 1 pass through strap apertures 13 in communication with the slot 12, as illustrated. The elements 7 are hollowed out at 7' to reduce weight.

The other side 9 of the vamp or leg portion carries the customary fastening levers 8 having spaced notches 8' for selectively receiving the fastening loops 1 during the closing of the boot.

FIG. 6 reveals how the strap extension 5 is flexed reversely to allow the fastening loop 1 to be adjusted longitudinally into engagement with a different one of the securing elements 7. Following such adjustment, the parts will lie in relation to each other as depicted in FIGS. 2 through 5. The described flexure of the strap extension 5 in FIG. 6 increases the width of the recessed portion 11" so that the loop 1 may easily embrace or engage the prechosen securing element 7. FIG. 7 shows the relationship of all parts following engagement of the adjusted loop 1 with fastening lever 8 and the movement of this lever to the boot closing position, the lever 8 being firmly attached to the other side 9 of the vamp or leg portion.

From the above description, it should be apparent that the invention offers numerous advantages including:

(1) The elimination of projections on the outer surface of the vamp or strap extensions with correspondingly improved appearance and with the possibility of using the outer surfaces to accept writing or other indicia.

(2) The complete elimination of intermediate connecting elements for attaching fastening loops to vamp or strap extensions, such loops being retained solely by their connections with the described securing elements and strap slots, etc.

(3) Very effective connection of the loop 1 with the vamp or strap because of the curving of the structure in final fastening, FIG. 7, which prevents separation of the loop 1 from the retaining or securing element 7. The strap curvature tends to close the groove entrance 11" in FIG. 7.

Figure 8:
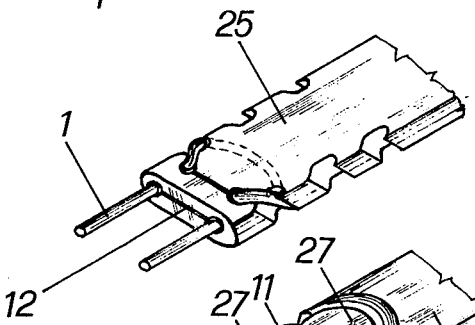
FIG. 8 is a fragmentary perspective view showing a modification of the invention.
Figure 9:
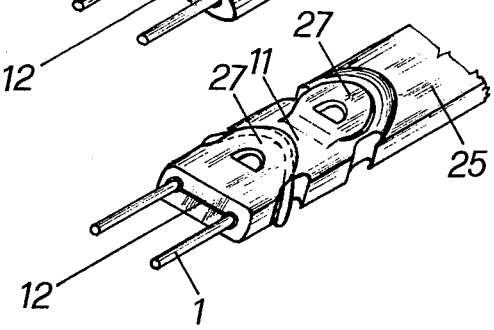
FIG. 9 is a similar view showing the interior side of the strap extension depicted in FIG. 8.
Figure 10:
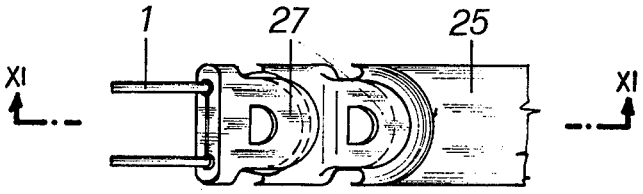
FIG. 10 is a fragmentary plan view of the strap extension in FIG. 9.
Figure 11:
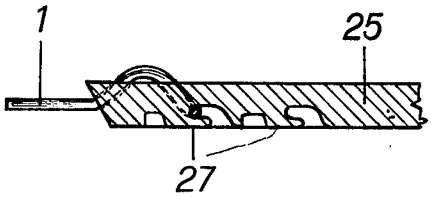
FIG. 11 is a longitudinal vertical section taken on line 11—11 of FIG. 10.

In the modification of FIGS. 8 through 11, the grooving of the strap 25 to retain the loop 1 adjustably is formed partly on the interior surface and partly in the opposite edges of the strap 25, FIGS. 8–10. The grooving produces on the interior strap surface loop retaining elements 27 of a similar nature to the described elements 7 of the prior embodiment. The particular embodiment shown in FIGS. 8–11 is applicable only to straps.

However, the modification in addition to the advantages possessed by the prior embodiment also offers the advantage of somewhat easier engagement of the loop 1 with a preselected retaining element 27.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A ski boot fastener comprising a leg portion including separated parts adapted to be fastened around a skier's leg, a mechanical fastener on one of said parts of the leg portion, a coacting fastening loop on the other part of said leg portion and extending beyond the free end of said other part for connection with said mechanical fastener, and said other part being formed on its interior surface to provide spaced securing elements for selective engagement with the fastening loop to thereby render the fastening loop adjustable longitudinally on said other part to plural fixed positions, said other part being also recessed in its interior surface in surrounding relation to said securing elements, whereby one end of said fastening loop can be selectively engaged around one of the securing elements while the fastening loop is within the recess of the interior surface of said other part, and said spaced securing elements being flush with the interior surface of said other part and said loop during usage lying below said interior surface.

2. A ski boot fastener according to claim 1, and said other part comprising at least one strap extension having a smooth outer face and said fastening loop projecting beyond the leading end of the strap extension, the leading end having a slot receiving the fastening loop adjustably and communicating with the recessed portion.

3. A ski boot fastener according to claim 1, and said mechanical fastener comprising a lever fastener having spaced notches selectively engageable with said fastening loop.

4. A ski boot fastener according to claim 1, and said one and said other parts are opposing parts of a vamp.

5. A ski boot fastener according to claim 1, and said fastening loop comprising an endless elongated cable loop having approximately parallel sides, said spaced securing elements rising from the bottom of a recess formed in the interior side of said other part, and said recess having side parallel portions receiving said parallel sides of the cable loop and transverse portions defining loop-engaging ends on said securing elements.

6. A ski boot fastener according to claim 5, and rearwardly projecting lips on the spaced securing elements overlying the bottom of the recess and beneath which the rear end of the fastening loop is selectively lockable with the fastening loop lying on the bottom of the recess of said other part.

7. A ski boot fastener according to claim 1, and the recessing on the interior side of the other part extending through opposite longitudinal edges of the other part adjacent opposite sides of the securing elements on the other part, the other part being a strap element.

8. A ski boot fastener according to claim 1, and wherein each securing element is approximately frustroconical and has a cavity in its top side away from the bottom of the recess of said other part.

* * * * *